United States Patent [19]

Gontowski, Jr.

[11] 4,389,638

[45] Jun. 21, 1983

[54] I.C. ALARM SIGNAL GENERATOR

[75] Inventor: Walter S. Gontowski, Jr., Thompson, Conn.

[73] Assignee: Sprague Electric Company, North Adams, Mass.

[21] Appl. No.: 307,057

[22] Filed: Sep. 30, 1981

[51] Int. Cl.[3] ..... G08B 3/00

[52] U.S. Cl. ..... 340/384 E; 331/108 C; 331/178

[58] Field of Search ..... 340/384 E; 331/178, 331/187, 108 C, 108 D

[56] References Cited

U.S. PATENT DOCUMENTS

| | | | |
|---|---|---|---|
| 3,877,004 | 4/1975 | Okada et al. | 340/384 E |
| 4,001,817 | 1/1977 | Squires | 340/384 E |
| 4,091,335 | 5/1978 | Giolma et al. | 331/108 C |
| 4,222,040 | 9/1980 | Benson et al. | 340/384 E |

*Primary Examiner*—Glen R. Swann, III

[57] ABSTRACT

A yelping alarm signal generator has a current controlled audio oscillator with a feedback loop around it that produces a control current that is a direct function of the oscillation frequency so that only one capacitor external to the integrated circuits is required.

5 Claims, 3 Drawing Figures

I.C. ALARM SIGNAL GENERATOR

BACKGROUND OF THE INVENTION

This invention relates to alarm signal generators and more particularly to integrated circuit (IC) alarm signal generating circuits for producing from a speaker sharp repeating yelping or whooping sounds.

Such a yelping sound is known to be unpleasant and to instill in those within earshot a sense of danger and alarm. Acoustic alarms of this type are useful in alarm systems designed to detect smoke and fire, clandestine intruders and the presence of poisonous gasses, inter alia.

It is known to generate yelp alarm sounds by driving a voltage controlled oscillator (VCO)12 with a periodic ramp voltage from a ramp generator circuit 14 as illustrated in FIG. 1. The output of the VCO 12 is connected to an IC driver or power amplifier 17 that drives a speaker 18. In integrated circuit form, each of these two oscillator circuits 12 and 14 normally requires at least one discrete capacitor connected to the integrated circuit. Such discrete capacitors 15 and 16 are typically much larger and more expensive than the integrated circuit portion of the system.

It is an object of this invention to provide a yelping type IC alarm generator that requires only one external capacitor.

It is a parallel object of this invention to provide such a generator having only one oscillator.

It is a further object of this invention to provide a low cost yelping alarm signal generator.

SUMMARY OF THE INVENTION

A yelping alarm signal generator includes a current controlled oscillator wherein a capacitor is periodically charged and discharged at a rate that is a function of a control current. A frequency to current converter means is connected in a feed back loop around the oscillator for producing the oscillator control current at a value that is a direct function of the oscillation frequency. The circuit is economically formed in integrated circuit form using standard building block circuits, e.g. flip flop counters and oscillators and requires the use of only one discrete capacitor external to the IC.

DESCRIPTION OF THE PREFERRED EMBODIMENT

Figure 1:
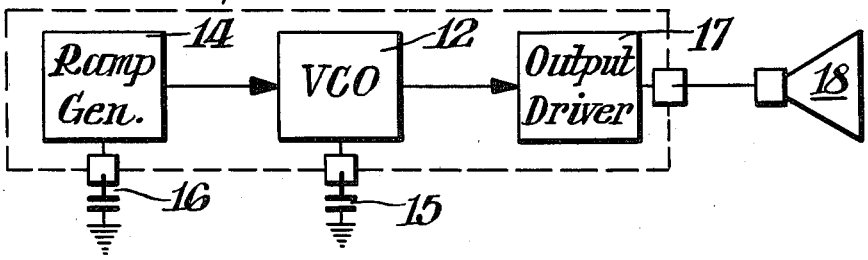
Fig. 1 (Prior Art)
FIG. 1 shows a block diagram of a yelping generator of the prior art.
Figure 2:
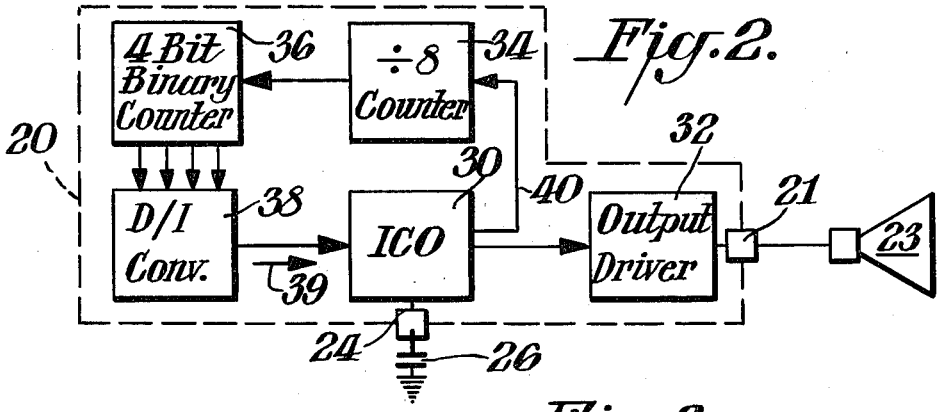
FIG. 2 shows a block diagram of the yelping generator of this invention.

An integrated circuit 20 includes a current controlled oscillator (ICO) 30. The output of oscillator 30 is connected to the input of a power driver amplifier 32 that supplies audio energy to the speaker 23. A divide-by-eight (÷8) counter 34 produces an output signal that has a fundamental frequency one eighth that of the oscillator 30. The counter 34 may be comprised of three flip flops (not shown) tandem connected in a standard ripple carry counter circuit configuration.

The low frequency output signal of the counter 34, taken at the output of the last of the tandem connected flip flops is fed to the input of a four bit binary ripple carry counter 36 made up of four tandem connected flip flops (not shown). An output from each of the counter (36) flip flops is connected to a digital-to-current (D/I) converter 38 to produce a current 39 at the input of the ICO 30 having a magnitude that is a direct positive function of and is step-wise proportional to the output frequency of the ICO 30. Counters 34 and 36 may be thought of as a frequency-to-digital-signal converter.

Thus the counters 34 and 36 with the converter 38 all taken together represent a frequency-to-current converter. It will now be appreciated that this frequency-to-current converter is employed as a positive feedback network around the ICO 30, imposing on the output signal of the oscillator a low frequency modulation signal. In this embodiment, the frequency of the ICO periodically ramps upward. Each ramp period includes 128 cycles of the ICO. Each ramp terminates when the standard binary coding counter 36 resets to zero. This effects a sudden drop in the control current 39 (to a value determined by the value of resistor 55 in FIG. 3). The next ramp then begins.

Figure 3:
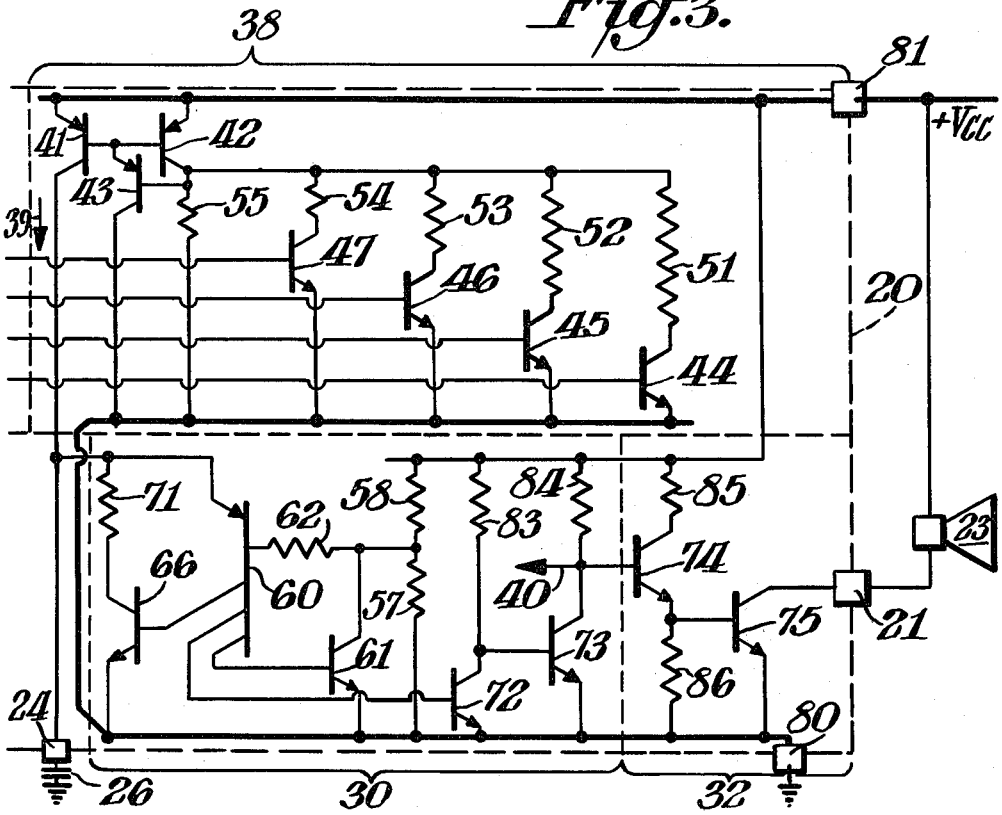
FIG. 3 shows a circuit diagram of the converter-oscillator-driver portion of the generator of FIG. 2.

The D/I converter (38) portion of the integrated circuit, as seen in FIG. 3, includes a current mirror circuit comprised of the three PNP transistors 41, 42 and 43. Depending on which of the transistor switches 44, 45, 46 and 47 are turned on, and depending on the resistance values for resistors 51, 52, 53, 54 and 55, the magnitude of the current established in the collector of transistor 41 and the rate of charging the capacitor 26 are determined. The transistor switches 44 through 46 are controlled by the binary count signal appearing at the multi-line output of the 4 bit binary counter (36).

The oscillator 30 operates briefly as follows. The capacitor 26 charges to a voltage about equal to that of the voltage divider formed by resistors 57 and 58 plus the base-emitter drop in the multi-collector transistor 60. At this time transistors 60 and 61 turn on and the capacitor 26 discharges mainly through the emitter base junction of transistor 60, the current limiting resistor 62 and the transistor 61. During discharge, transistor 66 also turns on and diverts at least some of the control current 39 away from the capacitor 26. Also included are amplifying transistors 72 and 73. A more detailed account of the operating principles of such an oscillator is provided in my U.S. Pat. No. 4,147,996 issued Apr. 3, 1979.

The current controlled oscillator circuit portion 30, shown in FIG. 3, produces a rectangular pulse at the input of the driver 32 and to the input to the counter 34 via line 40.

The conventional driver circuit 32 comprising transistors 74 and 75 provide amplification of the pulse signal via integrated circuit terminal pad 21 to speaker 23. Pads 80 and 81 are the circuit ground and positive D.C. supply voltage (+Vcc) terminals, respectively. The passive component values employed in this embodiment are given in the Table.

TABLE

| Resistors | Resistance (ohms) |
|---|---|
| 51 | 8K |
| 52 | 4K |
| 53 | 2K |
| 54 | 1K |
| 55 | 2.5K |
| 57 | 1.1K |
| 58 | 1.8K |
| 62 | 1K |
| 71 | 1K |

TABLE-continued

| | |
|---|---|
| 83 | 1K |
| 84 | 2.2K |
| 85 | 0.2K |
| Capacitor | Capacitance (microfarads) |
| 26 | 0.1 |

This system operates from a Vcc of from 10–20 volts and produces a piercing siren-like sound from the speaker 23.

What is claimed is:

1. A yelping alarm signal generator comprising:

a current controlled oscillator means for periodically charging and discharging a capacitor at a rate that is a function of a control current; and a frequency-to-current converter means being connected from an output to an input of said oscillator means for producing said control current and for setting the amplitude of said control current at a value that is a function of said rate of periodic charging and discharging.

2. The alarm signal generator of claim 1 wherein said frequency-to-current converter means is comprised of a binary counter means for producing a multi-line parallel binary coded signal corresponding to the output frequency of said current controlled oscillator means; and a digital-to-current converter for determining the amplitude of said control current in correspondence with said binary coded signal.

3. The alarm signal generator of claim 1 wherein said frequency-to-current converter means is comprised of a counter means for producing a periodic signal having a output frequency that is a fixed fraction of the frequency of said current controlled oscillator means of said oscillator means; a binary counter means for producing a multi-line binary coded signal corresponding to said fixed fraction frequency from said counter means; and a digital-to-current converter means for determining the amplitude of said control current in correspondence with said binary coded signal.

4. The alarm signal generator of claim 3 wherein said binary counter means is adapted to reset at a predetermined count to impart to said control current a periodic ramp waveform.

5. The alarm signal generator of claim 3 additionally comprising an output driver means being connected to the output of said oscillator means for driving an electro-acoustic transducer at said frequency of said oscillator means.

* * * * *